US006578302B1

(12) United States Patent
Benaquista et al.

(10) Patent No.: US 6,578,302 B1
(45) Date of Patent: Jun. 17, 2003

(54) SIGN ASSEMBLY

(75) Inventors: Vincent F. Benaquista, Delmont, PA (US); Shaun P. Blackham, Delmont, PA (US)

(73) Assignee: IDL Incorporated, Pittsburgh, PA (US)

( * ) Notice: Subject to any disclaimer, the term of this patent is extended or adjusted under 35 U.S.C. 154(b) by 5 days.

(21) Appl. No.: 09/886,503

(22) Filed: Jun. 21, 2001

(51) Int. Cl.[7] ..... G09F 7/02
(52) U.S. Cl. ..... 40/611; 40/489; 40/620
(58) Field of Search ..... 40/611, 661.03, 40/489, 618, 620; 403/353

(56) References Cited

U.S. PATENT DOCUMENTS 1,405,915 A * 2/1922 Haskel ..... 40/611
1,768,715 A 7/1930 Hopp
1,942,444 A * 1/1934 O'Connor ..... 40/592
2,345,913 A * 4/1944 Bishop ..... 40/606
2,627,683 A 2/1953 Leander
3,838,529 A 10/1974 Aybar
4,882,866 A 11/1989 Gebhardt
4,884,352 A 12/1989 Lipscomb

* cited by examiner

*Primary Examiner*—William L. Miller

(57) ABSTRACT

A sign assembly particularly useful for point of purchase displays is provided. The sign assembly provides an easily changeable sign portion, but when mounted remains securely in position. The sign assembly may utilize pre-existing structures for its support.

12 Claims, 7 Drawing Sheets

SIGN ASSEMBLY

BACKGROUND OF THE INVENTION

The present invention relates to a sign assembly, and, in particular, to a sign assembly including a sign portion that may be quickly installed in the assembly and, once installed, remains securely in place until its removal is desired.

Typically such sign assemblies include a frame structure often made of metal or plastic or the like, where a sign portion is held in place by the frame structure. Very often such frame structures do not offer the ease in changing the sign portion and at the same time provide a sign portion that is securely held in place once it is positioned in the sign assembly. Very often such sign assemblies are outside and exposed to the elements, or may be inside and exposed to people or other forces bumping the assembly, for example.

Various sign assemblies have been disclosed in the past, such as, U.S. Pat. No. 1,768,715, dated Jul. 1, 1930, issued to Hermann Hopp, et al., which discloses a display device for displaying price ticket holders. The ticket holders are removable. In one embodiment, the Hopp patent discloses a main body portion of elongated shape. Inwardly disposed end flanges integral with the ends of the main body portion are included. A channel member is carried by the main body portion and extends transversely in spaced relationship with the flanges. The oppositely disposed flanges formed integral with the channel member and are adapted to cooperate with their respective end flanges to retain a ticket in display position in the main portion. Tongues are carried by the channel members and are adapted for bending around the respective side edge of the body portion to retain the price tickets in position.

Other sign assemblies are known in the art such as disclosed in U.S. Pat. No. 2,627,683, dated Feb. 10, 1953, issued to Russell J. Leander, which discloses a foldable display made of sheet material, preferably paper or cardboard treated to make it waterproof or it may be of other sheet material. The Leander patent discloses that the invention is particularly adapted to being applied to the top of an oil pump casing but may have other applications to other casings which are generally rounded on top or at the upper edges. A display made of sheet material which is cut, scored and foldable to conform to a curved support. Means for attaching the ends of the sheet together and thus turning both of the ends of the oval scored base downwardly to conform to oppositely curved surfaces at relatively opposite sides of the top of the supporting structure are included. In one embodiment a resilient means extends through the display and against the scored portion in its outwardly turned position and fastening clips secured to the ends of the resilient means comprising hooks adapted to engage the sides of the support with the rounded top to which the display is attached.

In U.S. Pat. No. 3,838,529, dated Oct. 1, 1974, issued to Areas O. Aybar, is disclosed a nameplate for a directory comprising a strip and blank in which the strip is comprised of a thin, flexible, resilient deformed material having rounded ends forming lobes. The blank being a plastic engraveable blank secured to the strip. Nameplates are provided which are flexible to be bent in a slight curvature and are resilient to return to that shape when flattened. The nameplate is deformed and/or positioned to cause only the strip of the nameplate to fit into and engage folded-over edge portions of a holder.

Another such sign assembly is disclosed in U.S. Pat. No. 4,882,866, dated Nov. 28, 1989, issued to Roland Gebhardt, which discloses a signage system support structure formed from a pair of identical extruded multi-groove channel members. A connecting element is included in the form of an elongated rigid panel inserted into an unconstricted medial groove of each channel which serves to join two channels. Each channel is additionally formed with a constructed medial groove, and pair of outwardly facing grooves and a pair of lateral grooves on each side of and parallel to the medial grooves. In use, the upper and/or lower edges of the sign to be supported are engaged in one or more of the channel grooves with a flat sign having either opposed edges encased in the lateral grooves or a free edge in a constricted medial groove, an arcuate sign having its edges engaged in the outwardly facing grooves. The signs where supported displays may be formed with engaging tabs displaceable from the plane of the sign to engage a groove.

In U.S. Pat. No. 4,884,352 dated Dec. 5, 1989, issued to Robert S. Lipscomb, is disclosed a changeable sign assembly comprising a base with at least two retaining members attached to the base which has walls defining opposing longitudinal grooves. A number of display members having curved opposite edge portions which are formed of a thin resilient material. The edge portions are flexibly deformed by the longitudinal grooves to the retaining members so that the display members are removably retained by the retaining members.

Problems may arise with the prior art sign assemblies in that, outside forces, such as wind, for example, may cause the sign portion of the assembly to become inadvertently dislodged. Thus, there exists a need for a sign assembly that includes a sign portion that may be quickly and easily changed but will not be disturbed by outside forces, such as, wind.

SUMMARY OF THE INVENTION

The present invention provides a sign assembly useful in point of purchase advertising, such as, used in fuel stations, food stores, and the like. The sign assembly of the present invention, in one embodiment, includes a support member which may, for example, be the top or side of a gasoline pump, display stand, wall, or ceiling. Elongated oppositely disposed parallel flange members are included and are attached to the support member. The elongated flange members each include an elongated trough portion on one side thereof. The trough portion has a U-shaped cross section. Transverse pin members are mounted at predetermined intervals between opposite walls within the U-shaped trough portion.

A resilient laterally compressible sign member is provided which includes a sign portion, where a printed message for advertising and the like may be displayed. The sign portion has oppositely disposed parallel lip portions. The parallel lip portions are sized to engage the U-shaped trough portions of the flange members. The lip portions are provided with oppositely disposed pin member receiving openings. Each of the pin member receiving openings of the lip portions have a pin member docking portion, which is engageable with the transverse pin members, and the pin member locking portion substantially perpendicular to the pin member docking portion. The pin member receiving openings of the lip members and the transverse pin members are in operative alignment.

Utilizing this first embodiment of the present invention, the sign assembly may be quickly assembled by laterally compressing the sign member and aligning the pin members with the corresponding docking portion of the pin member receiving openings of the lip portions of the sign member. The sign member is then released after the pin members and docking portions of the pin member receiving openings are in alignment. The inherent resiliency of the sign member causes the docking portion of the receiving opening to receive the pin member so that the pin member enters the docking portion of the receiving opening. The sign member is then slid to engage the locking portion of the pin member receiving openings, thereby securing the sign member to the flange members.

The elongated flange members of the sign assembly may be affixed to the support member such that the U-shaped trough portions of the flange members face one another i.e., open towards one another, or, the elongated flange members may be affixed to the support member such that the U-shaped trough portions of the flange members face away from one another, i.e., open away from one another. Thus, the resilient sign member may have parallel lip portions that either extend outwardly or inwardly from the sign portion.

Preferably the pin members are mounted within the U-shaped trough portion of the flange member substantially perpendicular to the support member in this embodiment.

The sign portion of the resilient sign member, between the lip portions, may have a V-shaped cross-section, a curved cross-section, a flat or planar cross-section, for example.

Preferably, each of the flange members of this embodiment include an elongated integral mounting portion. The integral mounting portion is on the opposite side of each of the flange members from the U-shaped trough portion. Desirably, the integral mounting portion has first mounting apertures therein in predetermined position. The support member has second mounting apertures mounted therein also in predetermined position. The support member may be threaded proximate the second apertures. First mounting bolts are included that are in pass through relationship with the first mounting aperture of the integral mounting portion and in threadable engagement with the second aperture of the support member.

In a second embodiment of the present invention the sign assembly comprises a support member which may be structured as mentioned previously with the first embodiment, or may be a pole or the like. In this embodiment an elongated flange member includes a base portion attached to the support member and an elongated trough portion having a U-shaped cross-section. The trough portion is substantially perpendicular to the base portion. Transverse pin members are mounted in predetermined intervals between opposite walls within the U-shaped trough portion.

A sign member is provided which includes a sign portion having a lip portion on at least one side thereof. The lip portion is sized to engage the U-shaped trough portion of the flange member. The lip portion has a plurality of pin member receiving openings. Each of the pin member receiving openings of the lip portion have a pin member docking portion engageable with transverse pin members and a pin member locking portion position substantially perpendicular to the pin member docking portion. The pin member receiving openings of the lip member and the transverse pin members are in operative alignment.

By using this second embodiment the sign assembly may be quickly assembled by aligning the pin members of the flange member with the docking portion of the pin member receiving openings of the lip portion of the sign member and pushing on the sign member until the pin member enters the locking portion of the pin member receiving openings. Then the sign member is slid in the direction of the locking portion of the pin member receiving openings to cause the pin members to engage the locking portion of the pin member receiving openings, thereby securing the pin member to the sign member. The support member of this embodiment may be vertical or horizontal.

Preferably, the base member of this second embodiment has third mounting apertures passing therethrough in predetermined position. The support member is provided with fourth mounting apertures therethrough in predetermined position. The support member is threaded proximate the fourth apertures. Second mounting bolts are included. The second mounting bolts are in pass through relationship with the third apertures of the base member in threadable engagement with the fourth apertures of the support member.

Preferably, the sign assembly of this embodiment further includes a sign secondary securing assembly. The sign secondary securing assembly, preferably includes a secondary securing bolt. The U-shaped trough portion has fifth mounting apertures passing therethrough. A wing nut member is provided engageable with a secondary securing bolt, whereby when the secondary bolt passes through fifth apertures of the U-shaped trough and engages the wing nut member, the sign portion is ensured to remain in a fixed position on a support member despite any external forces.

BRIEF DESCRIPTION OF THE DRAWINGS

For a better understanding of the invention, reference may be had to the accompanying drawings exemplary of the invention in which.

BRIEF DESCRIPTION OF THE PREFERRED EMBODIMENTS

Figure 1:
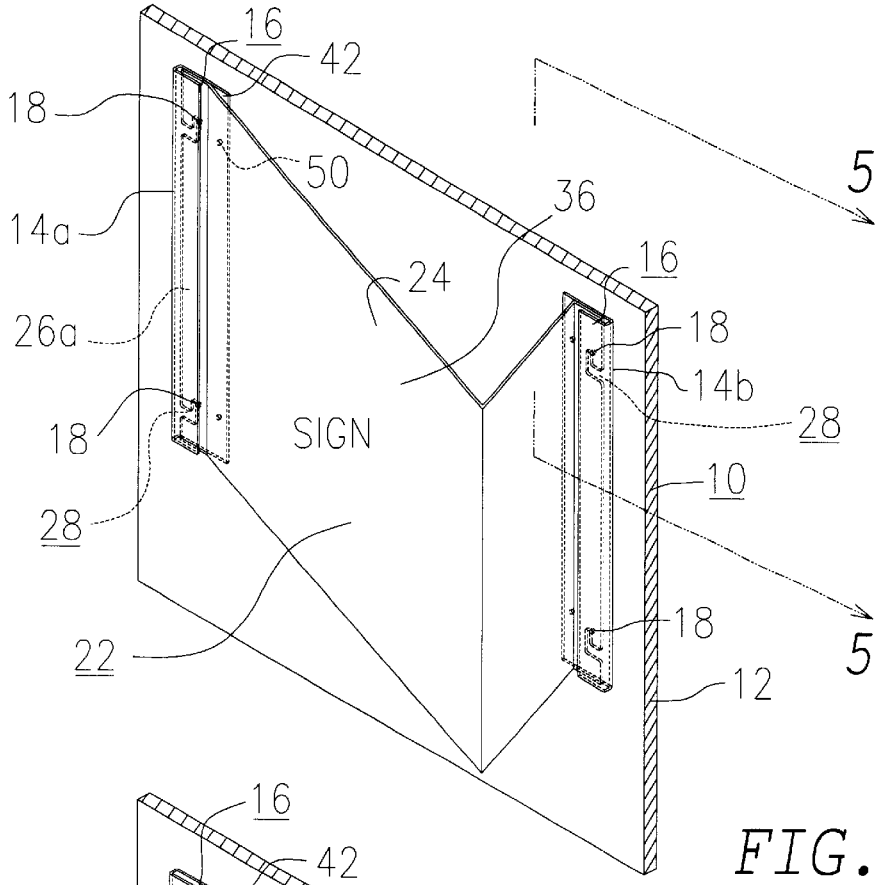
FIG. 1 is a perspective view, partly in section, of the first embodiment of the sign assembly of the present invention in mounted position.

With reference to FIG. 1, there is shown, the first embodiment of the present invention, the sign assembly 10. The sign assembly 10 includes a support member 12. The support member 12, as stated previously, may be the side or top of a gasoline pump at a fuel station, for example, or a wall, or display stand, or ceiling, for example.

Figure 2:
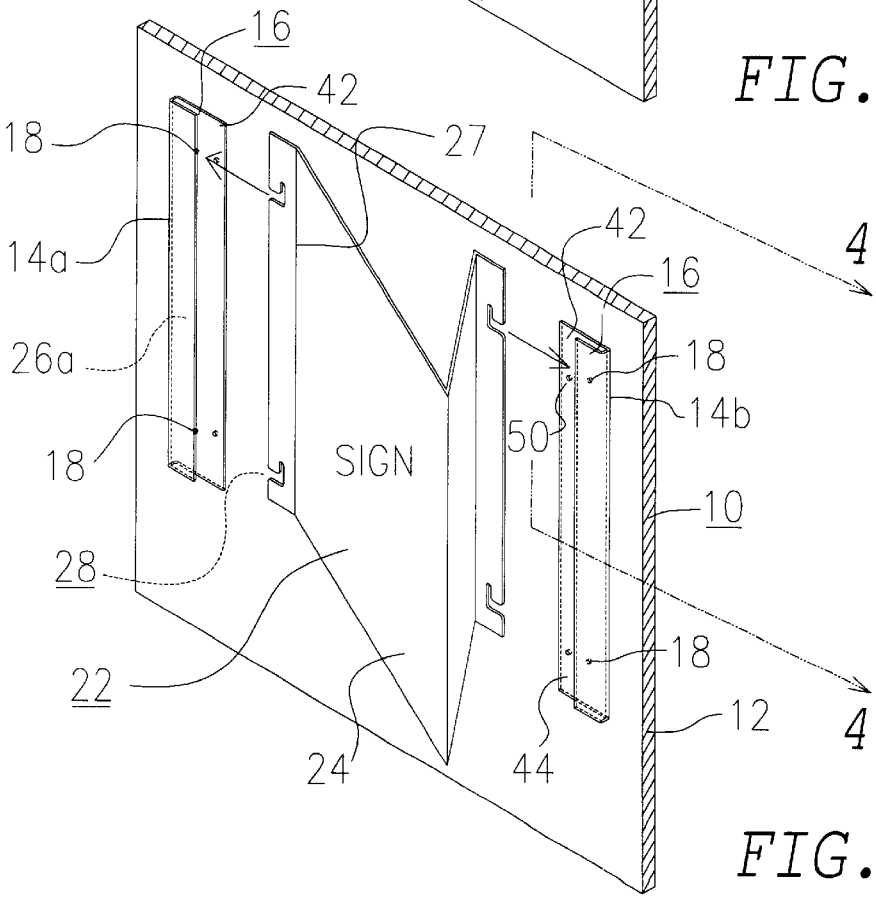
FIG. 2 is a perspective view, partly in section, of the first embodiment of the sign assembly of the present invention in a pre-mounted position.
Figure 3:
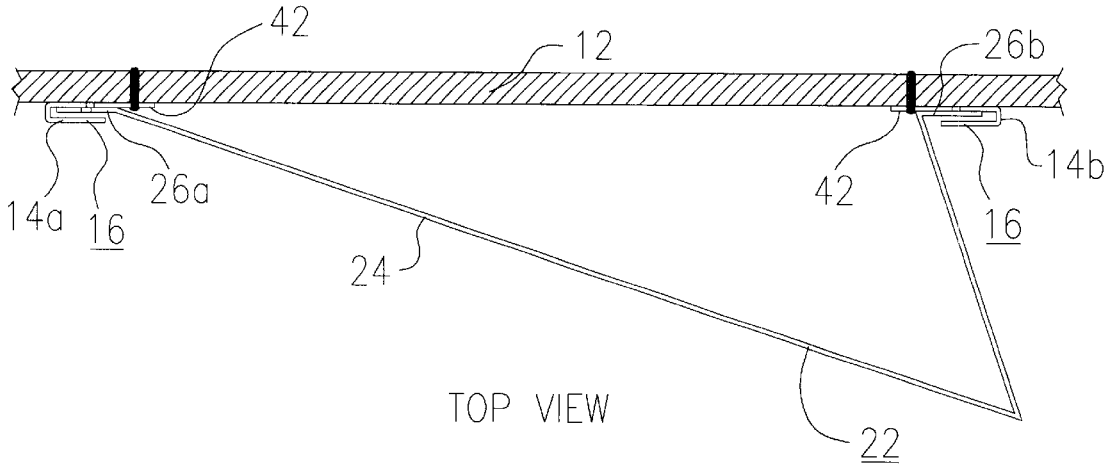
FIG. 3 is a top view of the sign assembly shown in FIG. 1.
Figure 4:
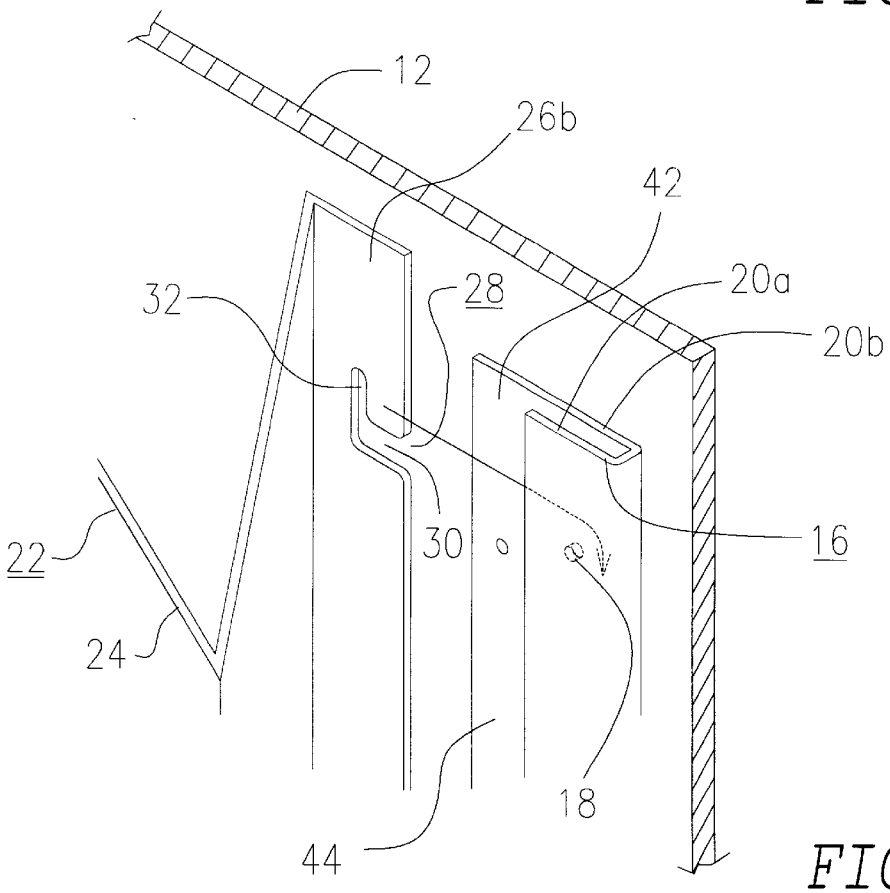
FIG. 4 is an enlarged perspective view showing a partial section of the sign assembly taken along the line 4—4 shown in FIG. 2 in the pre-mounted position.
Figure 5:
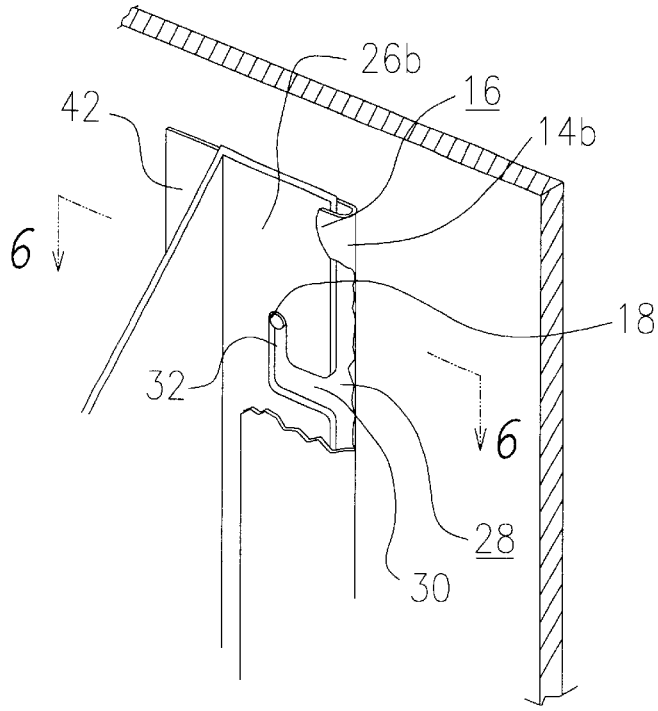
FIG. 5 is an enlarged perspective view showing a partial section of the sign assembly taken along the line 5—5 shown in FIG. 1 in the mounted position.

The sign assembly 10 also includes elongated oppositely disposed parallel flange members 14*a,* 14*b* attached to the support member 10. The elongated flange members 14*a,* 14*b* may be made of extruded aluminum, plastic or other material as is known in the art. The elongated flange members 14*a,* 14*b* each include an elongated trough portion 16 as shown in FIGS. 1–6, for example. The trough portion 16 has a U-shaped cross-section as can be seen in FIG. 4, for example. Transverse pin members 18 are mounted at predetermined intervals, such as shown in FIGS. 1 and 2, for example. The pin members are spaced to sufficiently secure the sign member 22, such as, 12 inches apart, for example. Referring to FIG. 5, the pin members 18 are mounted between opposite walls 20*a,* 20*b* within the U-shaped trough portion 16. A hole 21 is provided and sized to receive the pin member 18 in wall 20*b*. The pin 18 is inserted in hole 21 and is sized to contact wall 20*a*. The pin member 18 may then be welded to wall 20*b,* for example.

The sign assembly 10 of this embodiment also includes a resilient laterally compressible sign member 22 which may be made of flexible plastic, for example. The resilient laterally compressible sign member 22 includes a sign portion 24 having oppositely disposed parallel lip portions 26*a,* 26*b*. The lip portions 26*a,* 26*b* are sized to engage the U-shaped trough portions 16 of the flange members 14*b,* as shown in FIGS. 1, 3, 5 and 6, for example. The lip portions 26*a,* 26*b* have oppositely disposed pin member receiving openings 28 as shown in FIGS. 1, 2, 4, and 5, for example. Each of the pin member receiving openings 28 of the lip portions 26*a,* 26*b* have a pin member docking portion 30 enagageable with the transverse pin members 18 as shown in FIG. 5, and, a pin member locking portion 32 substantially perpendicular to the pin member docking portion as shown in FIGS. 4 and 5, for example. The pin members receiving openings 28 of the lip members 26*a,* 26*b* in the transverse pin members 18 are in operative alignment, as shown in FIGS. 1–5. The sign member is designed to cooperate with the flange members with the pin members 18 of the flange members 14*a,* 14*b* arranged to correspond to the pin members receiving openings 28 in lip portions 26*a,* 26*b* of the sign member 22. The lip portion 26*a,* 26*b* may be delineated by crease 27 in the sign portion 24, for example, as own in FIG. 2.

Utilizing the sign assembly 10 of this first embodiment of the invention, the sign assembly 10 may be quickly assembled by laterally compressing by hand, for example, the sign member 22 and aligning the pin members 18 with the respective docking portions 30 of the pin member receiving openings 28 of the lip portions 26*a,* 26*b* of the sign portion 24. The sign member 22 is then released after the pin members 18 and the docking portions 30 of the receiving openings 28 are in alignment. Sign member 22 is then slid in the direction shown by the arrow in FIG. 4 to engage the locking portion 32 of the pin member receiving opening 32, shown in FIG. 5, thereby securing the sign member 22 to the flange members 14*a,* 14*b*. FIGS. 4 and 5 show the operation with flange member 14*b,* the operation of flange member 14*a* in conjunction with the sign portion 24 would be identical to this.

Preferably, if the flange members 14*a,* 14*b* are vertically oriented as shown in FIGS. 1–7, the locking portion 32 should be oriented above the docking portion 30 as shown in those Figures. Gravity aids to hold the sign member in place in this configuration.

Figure 7:
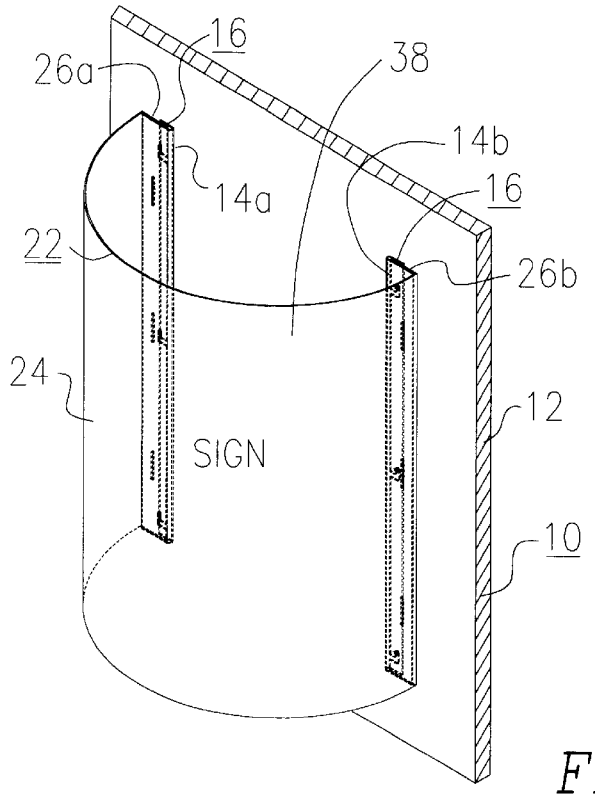
FIG. 7 is a perspective view of the sign assembly of the first embodiment, partly in section, showing a sign portion with a curved cross section and lip members inwardly extending.

Preferably the elongated flange members 14*a,* 14*b* are attached to the support member 12 such that the U-shaped trough portions 16 of the flange members 14*a,* 14*b* face one another as shown in FIG. 2, for example. An alternative to this is shown in FIG. 7, where the elongated flange members 14*a,* 14*b* are affixed to the support member 18 such that the U-shaped trough portions 16 of flange members 14*a,* 14*b* face away from one another or open away from one another.

Figure 6:
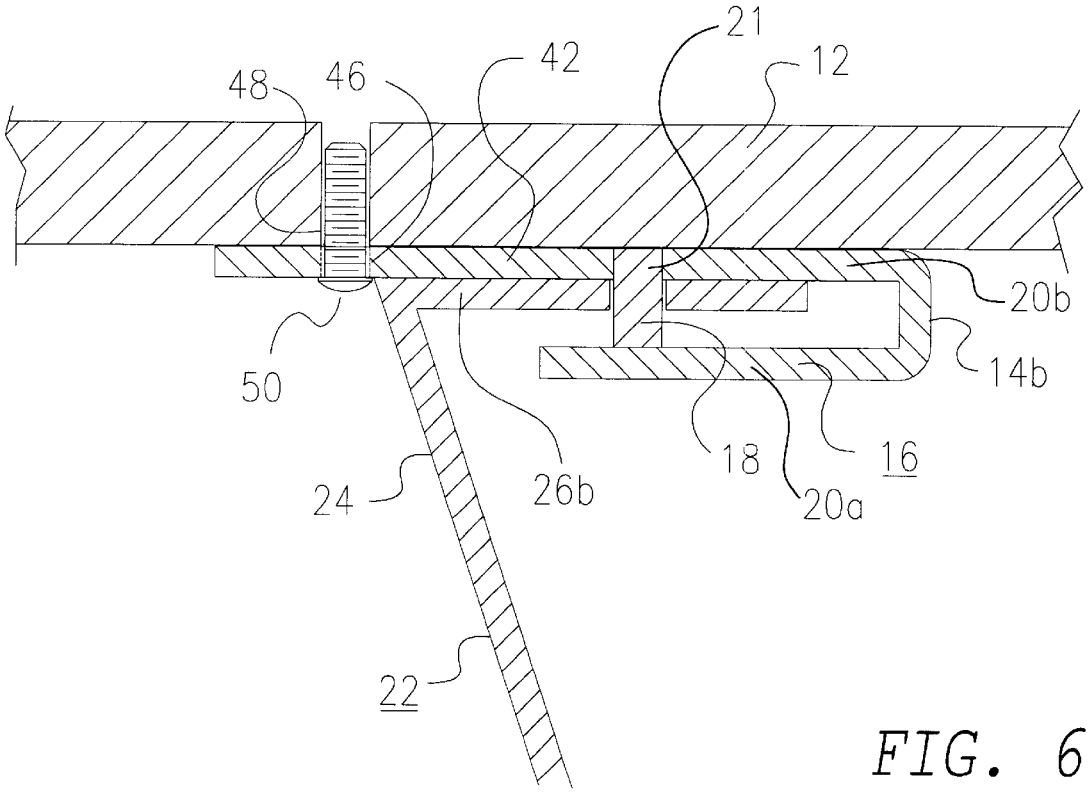
FIG. 6 is a cross-sectional view taken along the line 6—6 of FIG. 5.

Preferably the pin members 18 are mounted within the U-shaped trough portion 16 substantially perpendicular to the support member as shown in FIG. 6.

Figure 8:
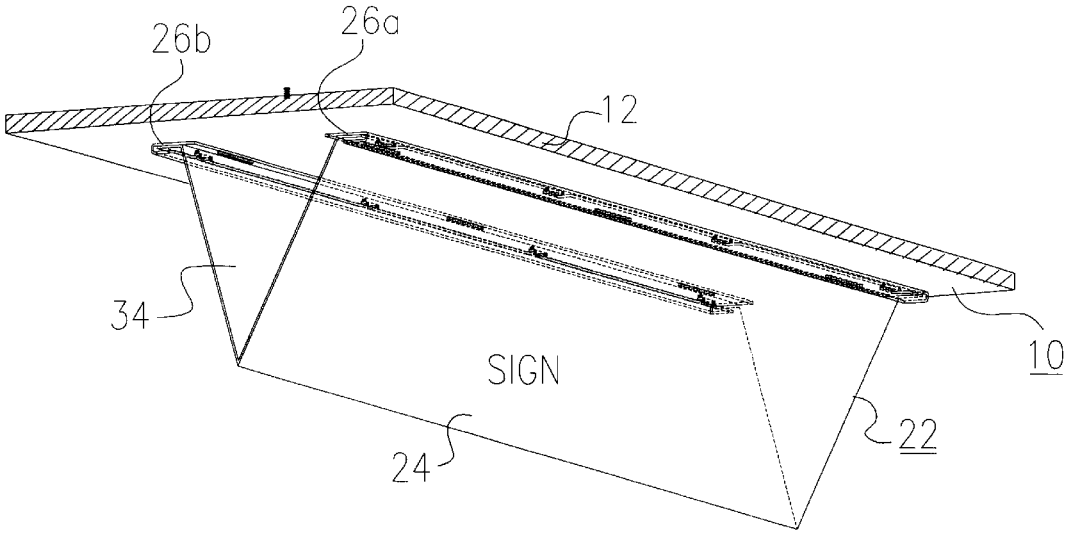
FIG. 8 is a perspective view of the perspective view of the first embodiment of the sign assembly, partly in section, showing a sign portion with a v-shaped cross-section and outwardly extending lip members utilizing an overhead support member.
Figure 9:
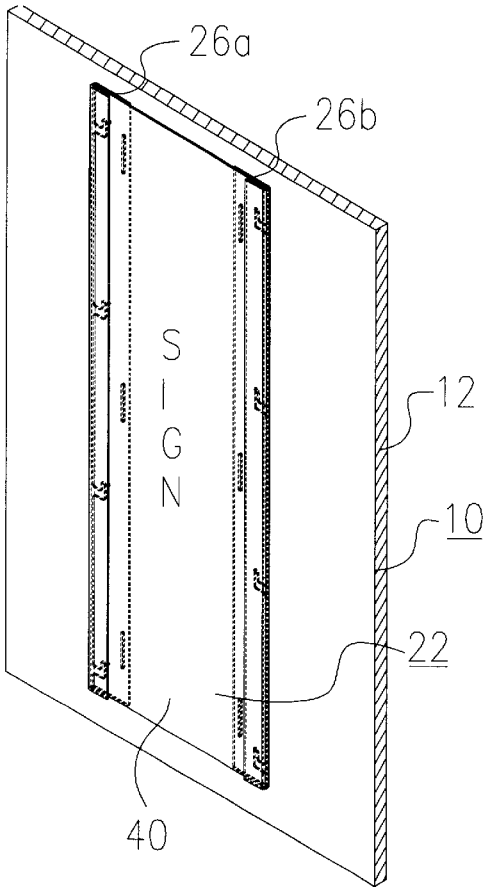
FIG. 9 is a perspective view of the first embodiment of the sign assembly, partly in section, showing a flat or planar version of the sign portion.

A sign portion 24 of the resilient sign member 22, excluding the lip portions 26*a,* 26*b,* may have a V-shaped cross-section 34 as shown in FIG. 8; an offset V-shaped cross-section 36 as shown in FIG. 1; a curved cross section 38 or may be flat 40 or planar as shown in FIG. 9.

Preferably each of the flange members 14*a,* 14*b* includes an elongated integral mounting portion 42 as shown in FIGS. 1–6. The integral mounting portion 42 is on the opposite side 44 on each of the flange members 14*a,* 14*b* shown in FIGS. 2 and 4, from the U-shaped trough portion 16. The integral mounting portion 42 has first mounting apertures 46 therein in predetermined position, and further shown in FIG. 6. The support member 12 has second mounting apertures 48 therein in predetermined position. The support member 12 is desirably threaded proximate the second apertures 48, the threading is not shown in the Figures. The mounting bolts or screws 50 are in pass through relationship with the first mounting aperture 46 of the integral mounting portion 42 and in threadable engagement with the second apertures 48 of the support member 12 as shown in FIG. 6. Of course, other methods of mounting the flange members 14*a,* 14*b* may be used including welding the flange members to support member 10, for example. The elongated oppositely disposed flange members 14*a,* 14*b* may be made of extruded aluminum as stated previously, or any other suitable material.

Figure 11:
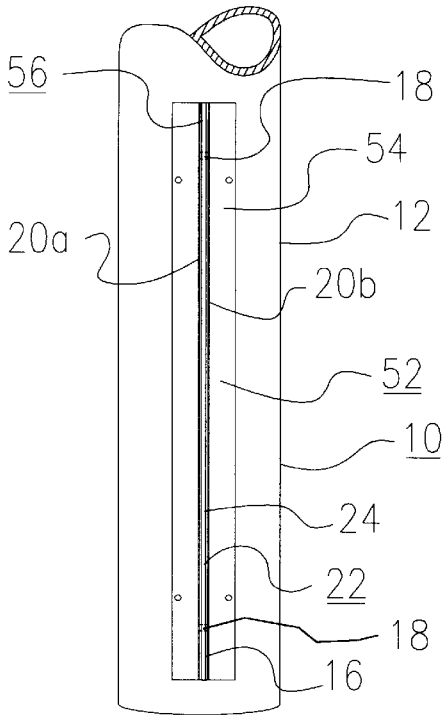
FIG. 11 is a side elevational view of the sign assembly shown in FIG. 10.
Figure 12:
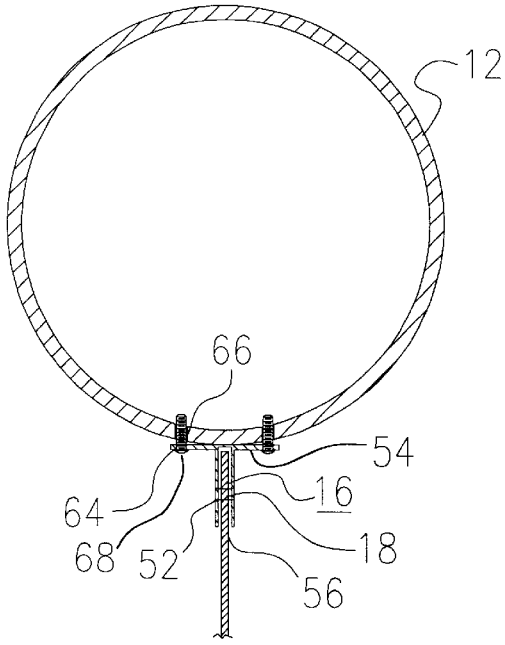
FIG. 12 is a cross-sectional view taken along the line 12—12 of FIG. 10.
Figure 13:
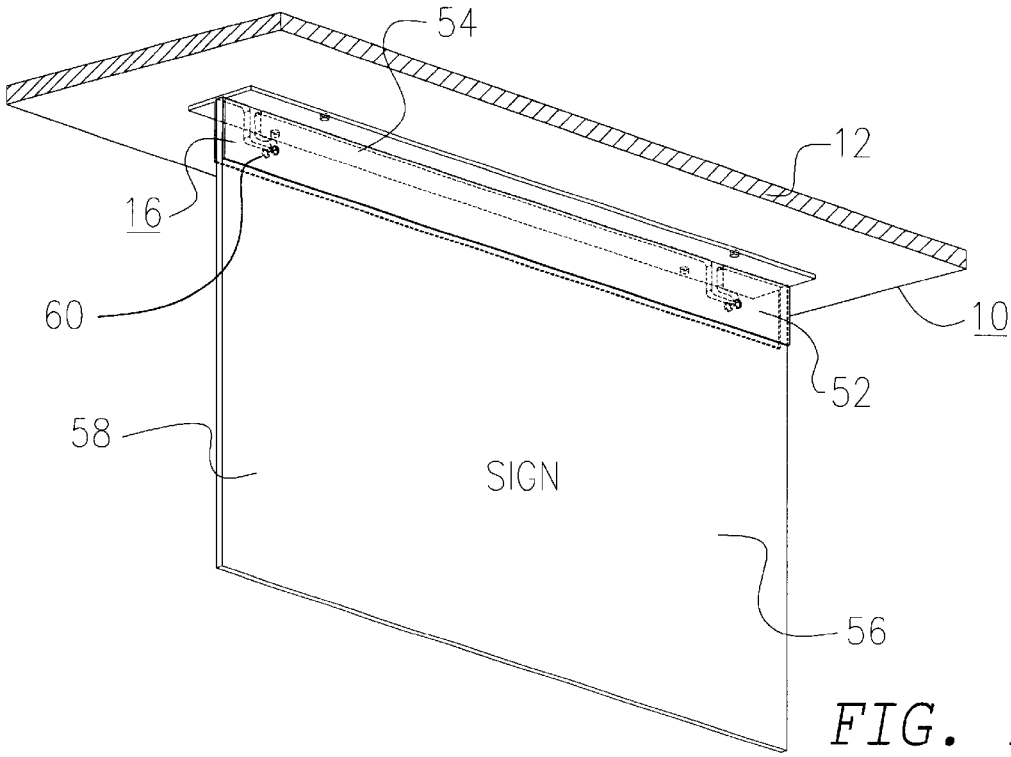
FIG. 13 is a perspective view of the second embodiment of the sign assembly showing an overhead support member; and, FIG. 14 is a perspective view of the sign portion of the sign assembly shown in FIG. 13.
Figure 14:
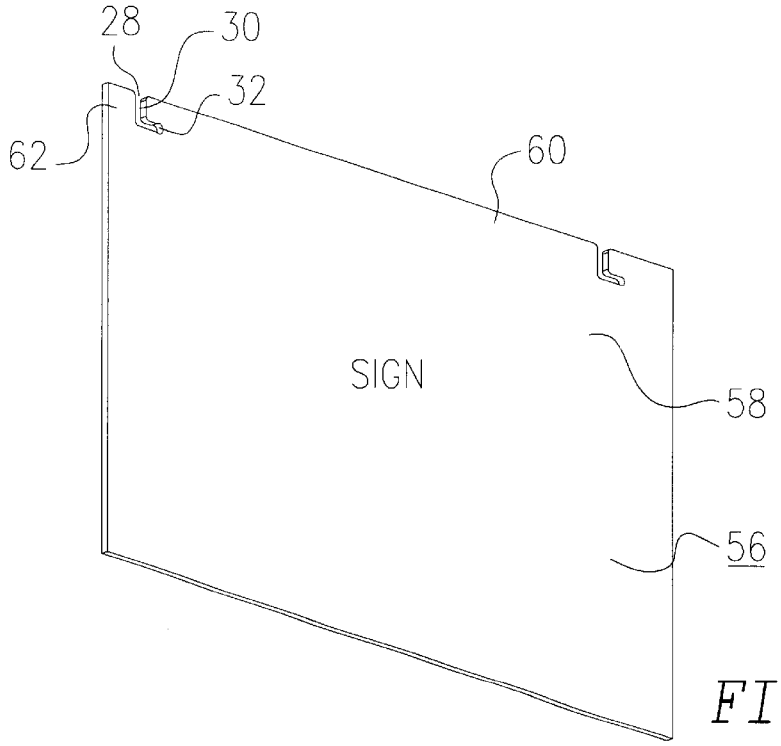

In the second embodiment of the invention where the same numerals are used to represent like elements. With reference to FIGS. 10–14, the sign assembly 10 of the second embodiment includes a support member 12, which as shown in FIGS. 10–13 may be a pole, or ceiling, a wall, not shown, or any other structure. The third elongated flange member 52 including a base portion 54 attached to the support member 12 and elongated trough portion having a U-shaped cross section 16. The trough portion 16 is substantially perpendicular to the base portion 54 as shown in FIGS. 10–13. Transverse pin members 18 are mounted at predetermined intervals between opposite walls 20*a,* 20*b* within the U-shaped trough portion as shown in FIGS. 11 and 12. The pin members 18 may be spaced like the pin members of the first embodiment. The second sign member 56 includes a second sign portion 58 which has a third lip portion 60 on at least one side 62 thereof. The third lip portion 60 is sized to engage the U-shaped trough portion 16 of the third flange member 52. The third lip portion 60 has a plurality of pin member receiving openings 28. Each of the pin member receiving openings 28 of the third lip portion 60 has a pin member docking portion 30 engageable with the transverse pin members 18 and a pin member locking portion 30 positioned substantially perpendicular to the pin member docking portion as shown in FIG. 14 which would be the same as the pin member receiving opening 28 shown in FIGS. 4 and 5 therein. The pin member receiving openings 28 of the third lip portion 60 and the transverse pin members 18 are in operative alignment as discussed previously with the first embodiment.

Utilizing the second embodiment, the sign assembly 10 may be quickly assembled by aligning the pin members 18 of the third flange member 52 with the docking portion 30 of the pin member receiving openings 28 of the second sign member 56 and pushing on the second sign member until the pin member 18 enters the locking portion of the receiving openings 28. The second sign member is then slid in the direction of the locking portion 32 of the pin member receiving openings 28 to cause the pin members 18 to engage the locking portions 32 of the pin member receiving openings 28, thereby securing the second sign member 56 to the third flange member 52. The second sign member 56 is not required to be resilient.

Preferably the support member 12 of the second embodiment may be vertical or horizontal. Preferably the base portion 54 has third mounting aperture 64 passing therethrough in predetermined position as shown in FIG. 12. The support member 12 is preferably threaded proximate the fourth aperture 66 not shown in the figures. Second mounting bolts or screws 68 are provided in pass through relationship with the third aperture 64 of the base portion 54 in threadable engagement with the fourth aperture 66 of the support member 12 as shown in FIG. 12. The third elongated flange member 52 of the present invention may also be made of extruded aluminum, for example, or any other suitable material. The mounting of the third flange member 52 described in this embodiment, like the previous embodiment, instead of mounting bolts in respective apertures, welding could be utilized assuming the materials are appropriate or any other mounting means.

Figure 10:
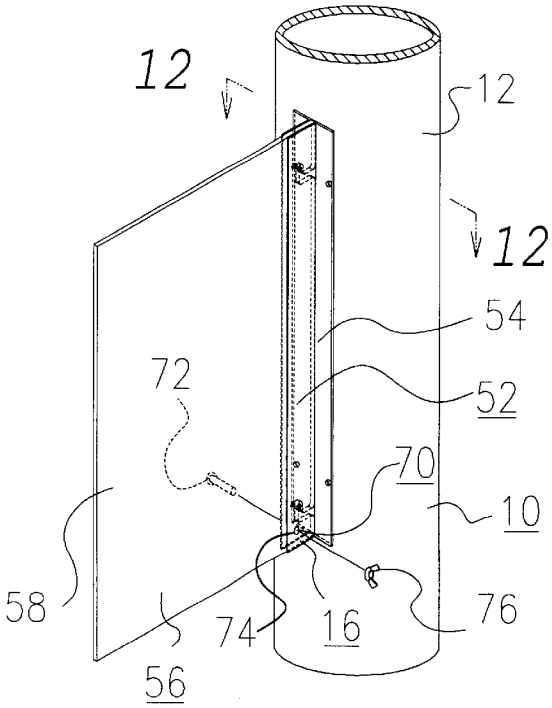
FIG. 10 is a perspective view of the second embodiment partly in section showing the sign assembly utilizing a support member such as a pole.

The sign assembly 10 of the second embodiment may also preferably further include a sign secondary securing assembly 70 shown in FIG. 10. The sign secondary securing assembly 70 includes a secondary securing bolt 72. The U-shaped trough portion 16 has a fifth mounting aperture 74. A wing nut 76 is provided and is engageable with the secondary securing bolt 72, whereby the secondary securing bolt 72 passes through the fifth mounting aperture 74 of the U-shaped trough 16 and engages the wing nut member 76, the sign portion 58 is ensured to remain in a fixed position on support member 12 despite any external forces such as wind or human forces, for example.

What is claimed is:

1. A sign assembly comprising:

a support member, elongated oppositely disposed parallel flange members affixed to said support member, said elongated flange members each including an elongated trough portion on one side thereof having a U-shaped cross-section, transverse pin members mounted at predetermined intervals between opposite walls with said U-shaped trough portion, a resilient laterally compressible sign member including a sign portion having oppositely.disposed parallel flat lip portions, said lip portions sized to engage said U-shaped trough portions of said flange members, said lip portions having oppositely disposed pin member receiving openings, each of said pin member receiving openings of said lip portions having a pin member docking portion engageable with said transverse pin members and a pin member locking portion substantially perpendicular to said pin member docking portion, said pin member receiving openings of said lip members and said transverse pin members in operative alignment, whereby, said sign assembly may be quickly assembled by laterally compressing said sign member and aligning said pin members with the docking portion of said pin member receiving openings of said lip portions of said sign portion and releasing said sign member after said pin members and docking portions of said pin member receiving openings are in alignment and then sliding said sign member to engage said locking portion of said pin member receiving openings thereby securing said sign member to said flange members.

2. The sign assembly of claim 1, wherein said elongated flange members are affixed to said support member such that said U-shaped trough portions of said flange members face one another.

3. The sign assembly of claim 1, wherein said elongated flange members are affixed to said support member such that said U-shaped trough portions of said flange members face away from one another.

4. The sign assembly of claim 1, wherein said pin members are mounted within said U-shaped trough portion of said flange member substantially perpendicular to said support member.

5. The sign assembly of claim 1, wherein said sign portion of said resilient sign member has a V-shaped cross-section.

6. The sign assembly of claim 1, wherein said sign portion of said resilient sign member has an offset V-shaped cross-section.

7. The sign assembly of claim 1, wherein said sign portion of said resilient sign member has a curved cross-section.

8. The sign assembly of claim 1, wherein said sign portion of said resilient sign member is flat.

9. The sign assembly of claim 1, wherein each of said flange members includes an elongated integral mounting portion, said integral mounting portion on the opposite side of each of said flange members from said U-shaped trough portion.

10. The sign assembly of claim 9, wherein said integral mounting portion has first mounting apertures therein in predetermined position.

11. The sign assembly of claim 10, wherein said support member has second mounting apertures therein in predetermined position, said support member being threaded proximate said second apertures.

12. The sign assembly of claim 11, further comprising first mounting bolts, said mounting bolts in pass through relationship with said first mounting aperture of said integral mounting portion and in threadable engagement with said second apertures of said support member.

* * * * *